US005546847A

United States Patent [19]

Rector et al.

[11] Patent Number: 5,546,847

[45] Date of Patent: Aug. 20, 1996

[54] HYDRAULIC CYLINDER SNUBBING ARRANGEMENT

[75] Inventors: Charles E. Rector, Waubun, Minn.; Steven R. Wells, Aurora, Ill.; Daniel T. Mather, Lockport, Ill.; Robin S. Arndt, Crest Hill, Ill.

[73] Assignee: Caterpillar Inc., Peoria, Ill.

[21] Appl. No.: 526,831

[22] Filed: Sep. 12, 1995

[51] Int. Cl.[6] ..... F15B 11/048; F15B 11/044

[52] U.S. Cl. ..... 91/403; 91/405; 91/459; 91/464; 137/625.64

[58] Field of Search ..... 91/403, 405, 406, 91/459, 464; 137/625.64

[56] References Cited

U.S. PATENT DOCUMENTS 4,355,660 10/1982 Huffman ..... 91/464 X

*Primary Examiner*—Gerald A. Michalsky
*Attorney, Agent, or Firm*—John W. Grant

[57] ABSTRACT

A hydraulic cylinder snubbing arrangement includes a pilot operated control valve having a predetermined snubbing position at which flow exhausted from a hydraulic cylinder actuating chamber must pass through a plurality of flow restricting orifices in a valve spool when the hydraulic cylinder is retracted to a predetermined position. The valve spool is shifted to the snubbing position automatically by reducing the fluid pressure in a pilot chamber at the end of the valve spool to a predetermined level so that a snubber spring device resiliently moves the spool from a lower or float position. By forcing the fluid to pass through the restricted flow path created by the orifices, the gravity induced velocity of the hydraulic cylinder is greatly reduced as the hydraulic cylinder approaches its end of stroke position.

17 Claims, 4 Drawing Sheets

HYDRAULIC CYLINDER SNUBBING ARRANGEMENT

TECHNICAL FIELD

This invention relates to a hydraulic cylinder snubbing arrangement including an electrohydraulic control valve having a preselected snubbing position for reducing the gravity induced velocity of a hydraulic cylinder as the hydraulic cylinder approaches its end of stroke position.

BACKGROUND ART

Many off highway trucks have hoist systems designed to lower the body at a high velocity, thereby minimizing the float/lower time, improving the truck's productivity. The highest velocity is limited by the impact the operator is willing to tolerate when the body contacts the pads during the final portion of the float/lower range. In an attempt to maintain reasonable float/lower times, truck designs have compromised on operator comfort allowing harsh impacts of the body on the body resting pads. These harsh impacts, in some cases, have lead to operator complaints. In addition, harsh impacts adversely contribute to overall operator sound levels and undesirable frame loading.

Snubbers have been added to the hoist systems of some off highway trucks to allow the truck to maintain or improve its productivity while, at the same time, reducing the impact when the body contacts the resting pads. Typically, the snubbing functions have been done by reducing the flow area at the cylinder outlet to restrict fluid flow from the cylinder as the cylinder nears its mechanical stop. Traditional cylinder snubbers work by locally increasing the restriction in the head or rod end of each cylinder independently, potentially placing seals and structural parts under extreme pressures. Additionally, many of the in-cylinder snubber designs have been eminently expensive with the added risk of interference between moving parts leading to opportunities for mechanical failures and contamination within the hydraulic system. Moreover, the correct function of the in-cylinder snubbers is dependent on close dimensional tolerances, not only within the cylinder, but also tolerances associated with the cylinder mounting and vehicle frame geometry. Maintaining close tolerances for snubbing components across two cylinder seals is especially difficult for dual stage cylinders typically used on off highway trucks. Finally, the in-cylinder snubbers commonly generate high pressure spikes due to the difficulty of providing precise metering characteristics at the interaction of the moving parts incorporated into a cylinder. Moreover, when a pair of hoist cylinders having in-cylinder snubbing are used, it is extremely difficult to assure that the snubbing loads will be equally shared by both cylinders.

Thus, it would be desirable to provide the snubbing function within the control valve so that the pressure spikes can be more carefully controlled due to the precise metering characteristics of valves and the snub loads will be equally shared between cylinders. It would also be advantageous to provide the snubbing function within the control valve so that the number of components does not have to be duplicated, thereby saving the cost compared with duplicate snubber parts in each cylinder.

The present invention is directed to overcoming one or more of the problems as set forth above.

DISCLOSURE OF THE INVENTION

In one aspect of the present invention, a hydraulic cylinder snubbing arrangement is disposed to reduce the velocity of a hydraulic cylinder as the hydraulic cylinder nears its end of stroke position wherein the hydraulic cylinder has at least one actuating chamber. A pilot operated control valve is disposed to control fluid flow into and out of the actuating chamber and includes a valve spool movable to a first discrete operating position establishing substantially unrestricted fluid flow out of the actuating chamber and to a second discrete operating position establishing a restricted flow path out of the actuating chamber, a pilot chamber at one end of the valve spool, and a snubber spring device disposed to resiliently bias the spool from the first operating position to the second operating position when the fluid pressure in the pilot chamber is reduced from a first pressure level to a second lower pressure level. A valve means establishes the first pressure level in the pilot chamber in response to receiving a first control signal and the second lower pressure level in the pilot chamber in response to receiving a second control signal. A means is provided for directing the first control signal to the valve means in response to receiving a command signal. Another means provides for directing the second control signal to the valve means when the hydraulic cylinder nears its end of stroke position.

BEST MODE FOR CARRYING OUT THE INVENTION

Figure 1:
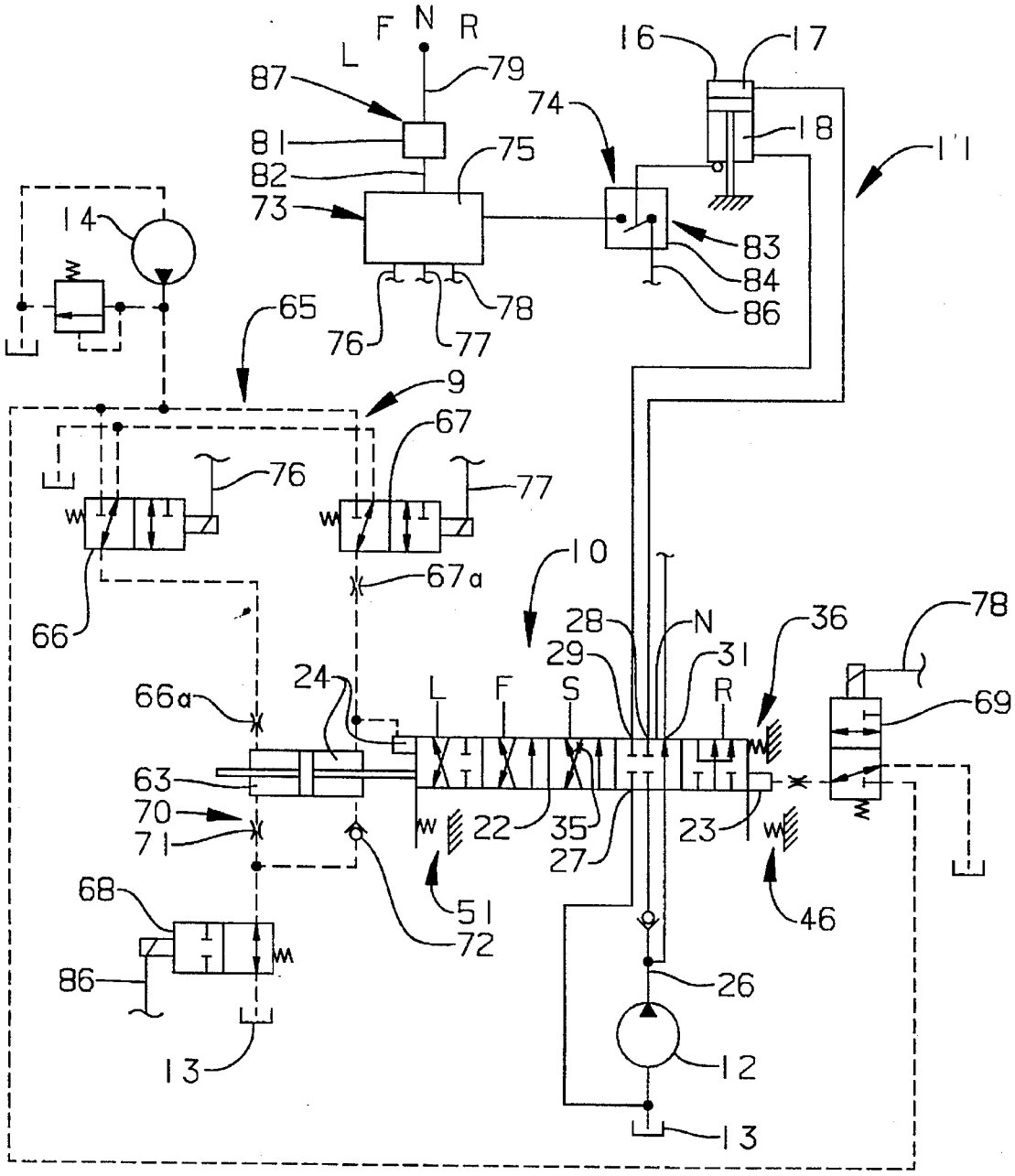
FIG. 1 is a schematic illustration of an embodiment of the present invention.

Referring to the drawings, a hydraulic cylinder snubbing arrangement 9 includes a pilot operated control valve 10 in combination with a hydraulic system 11 having a pump 12 connected to a tank 13, a source of pilot fluid such as a pilot pump 14 and a hydraulic cylinder 16 having a pair of actuating chambers 17,18 with chamber 17 being a load supporting chamber.

The control valve 10 includes a body 19 having a valve spool bore 21 defined therein and a valve spool 22 slidably disposed within the bore defining a pair of pilot chambers 23,24 at opposite ends thereof. The body also includes an intake port 26 connected to the pump 12, an exhaust port 27 connected to the tank, a pair of cylinder ports 28,29 connected to the actuating chambers 17,18 respectively and a bypass port 31. The ports are axially spaced along and communicate with the valve spool bore 21. The valve spool includes a land 32 adjacent an annular groove 33 and a plurality of passages 34 communicating the land 32 with the annular groove 33. As hereinafter described, a restricted flow path 35 is established through the passages 34 at a preselected position of the valve spool.

A resilient centering device 36 is disposed within the pilot chamber 23 for resiliently biasing the valve spool to the neutral position shown. The centering device 36 includes a spring retainer 37 carried by an extension 38 extending axially from the spool 22, a sleeve 39 slidably carried on the extension and retained thereon by a snap ring 41, and a spring 42 disposed between the spring retainer and the sleeve 39. At the neutral position shown, the spring 42 normally resiliently urges the spring retainer 37 into contact with the valve body and the sleeve against a washer 43 engaging a shoulder 44.

A bumper spring device 46 is also disposed within the pilot chamber 23 and includes a sleeve 47 resiliently urged into abutment with the valve body by a spring 48 positioned between the washer 43 and an inwardly extending flange 49 of the sleeve 47.

A snubber spring device 51 is disposed within the pilot chamber 24 and includes a spring 52 positioned between a pair of spring retainers 53,54 slidably carried on an extension 56 of the valve spool. The snubber spring device is maintained in a preloaded condition by a snap ring 57. The spring retainer 54 is spaced a predetermined distance from an annular shoulder 58 when the valve spool is at the neutral position shown. A bore 61 opens into the pilot chamber 24 and slidably receives a power piston 62 which engages one end of the valve spool and defines an pilot chamber 63 at the non-engaging end of the piston.

A valve means 65 is provided for establishing a first pressure level in the pilot chamber 63 in response to receiving a first control signal and for establishing a second lower pressure level in the pilot chamber in response to receiving a second control signal. The valve means 65 in this embodiment includes three two position solenoid valves 66,67,68. The solenoid valves 66 and 67 are commonly connected to the pilot pump 14 and the tank 13 and are respectively connected to the pilot chambers 63 and 24 through a pair of orifices 66*a* and 67*a*. The solenoid valve 68 is connected to the tank 13 and to the pilot chamber 63 through a flow restricting orifice 71 and to the pilot chamber 24 through a check valve 72. The solenoid valves 66, 67 and 68 are shown in their de-energized off position. Preferably, the solenoid valves are conventional cartridge type valves having portions thereof suitably fitted within threaded bores provided in the body and connected to the respective pilot chambers through passages also provided in the body. The orifices 66*a* and 71 constitutes a means 70 for reducing the pressure level of the fluid in the pilot chamber 63 to a predetermined level lower than pilot system pressure when the solenoid valve 66 is in its on position and the solenoid valve 68 is in its off position. Another two position solenoid valve 69 is also connected to the pump and the tank and to the pilot chamber 23.

A control means 73 is provided for directing the first control signal to the valve means 65 in response to receiving a command signal. Similarly, a control means 74 is provided for directing the second control signal to the valve means when the hydraulic cylinder nears its end of stroke position. The means 73 includes a microprocessor or controller 75 electrically connected to the solenoid valves 66, 67 and 69 through lead lines 76, 77, 78 respectively and a control lever 79 operatively connected to a position sensor 81 which in turn is connected to the controller through a lead line 82. The control lever is movable from the neutral position shown to three discrete operating positions represented by the letters "R", "F" and "L". Moving the control lever to each of these positions directs separate discrete command signals to the solenoid valves for establishing various operating conditions as hereinafter described.

The means 74 includes a means 83 for de-energizing the solenoid valve 68 at a predetermined retracted position of the hydraulic cylinder. The means 83 can include, for example, an electrical switch 84 connected to the controller 75 and to the solenoid valve 68 through a lead line 86. The switch 84 is suitably positioned relative to the hydraulic cylinder 16 so that the switch closes to energize the solenoid valve 68 when the hydraulic cylinder is extended beyond the predetermined retracted position and automatically opens to energize the solenoid 68 when the hydraulic cylinder is retracted to the predetermined position which is near its end of stroke position. The second control signal in this embodiment is the absence of an electrical signal directed to the solenoid 68.

While the switch 84 is diagrammatically shown as being actuated by the cylinder itself, alternatively the switch could be positioned relative to machine components such as a truck body raised and lowered by the hydraulic cylinder.

The control lever 79, the position sensor 81 and the lead line 82 provide a means 87 for outputting a command signal to establish a desired operation of the hydraulic cylinder. The controller 75 processes the command signals from the sensor, produces the first discrete control signal in response to the command signal and outputs the first control signal to the control valves 66, 67.

Figure 3:
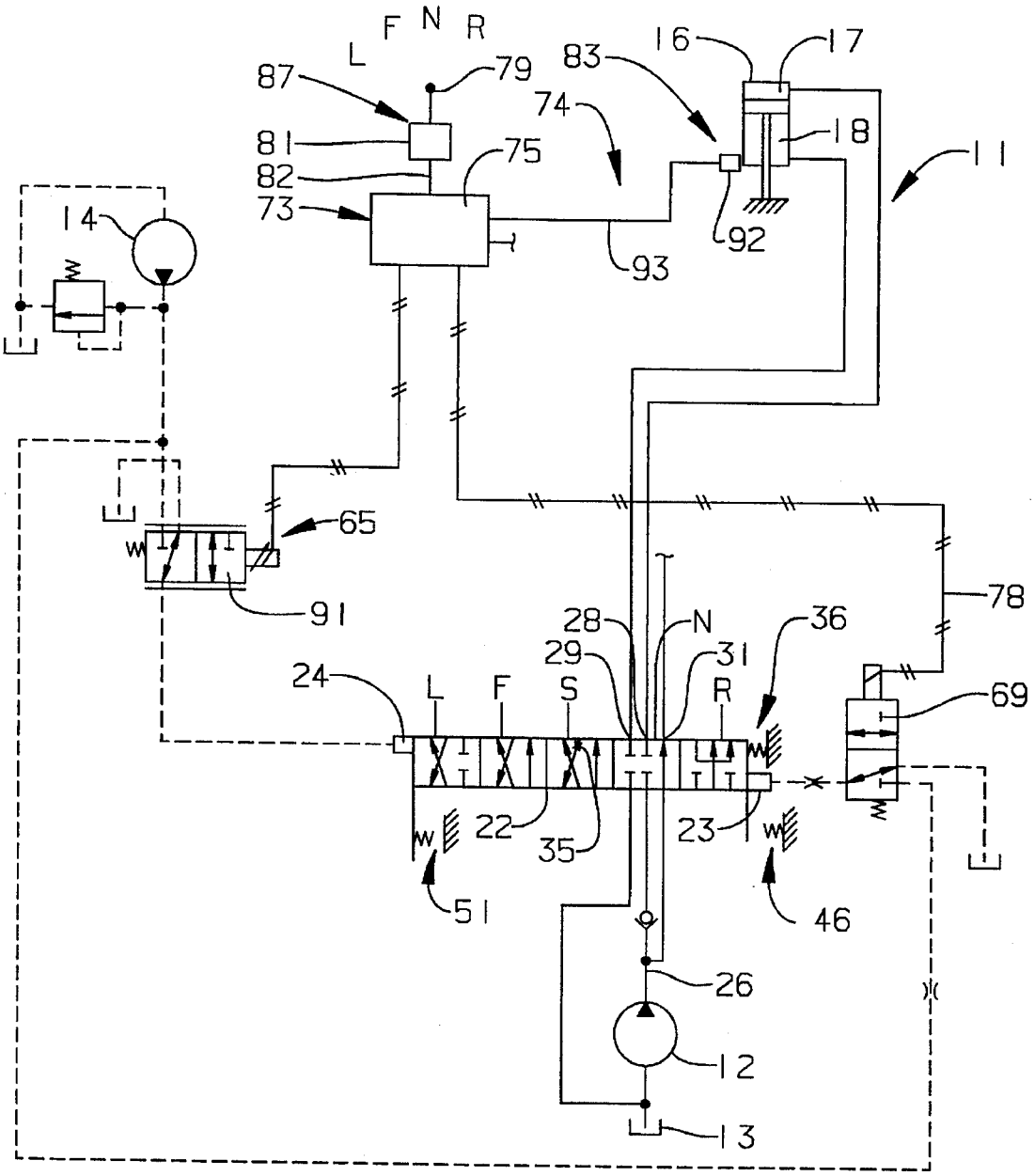
FIG. 3 is a schematic illustration of another embodiment of the present invention.
Figure 4:
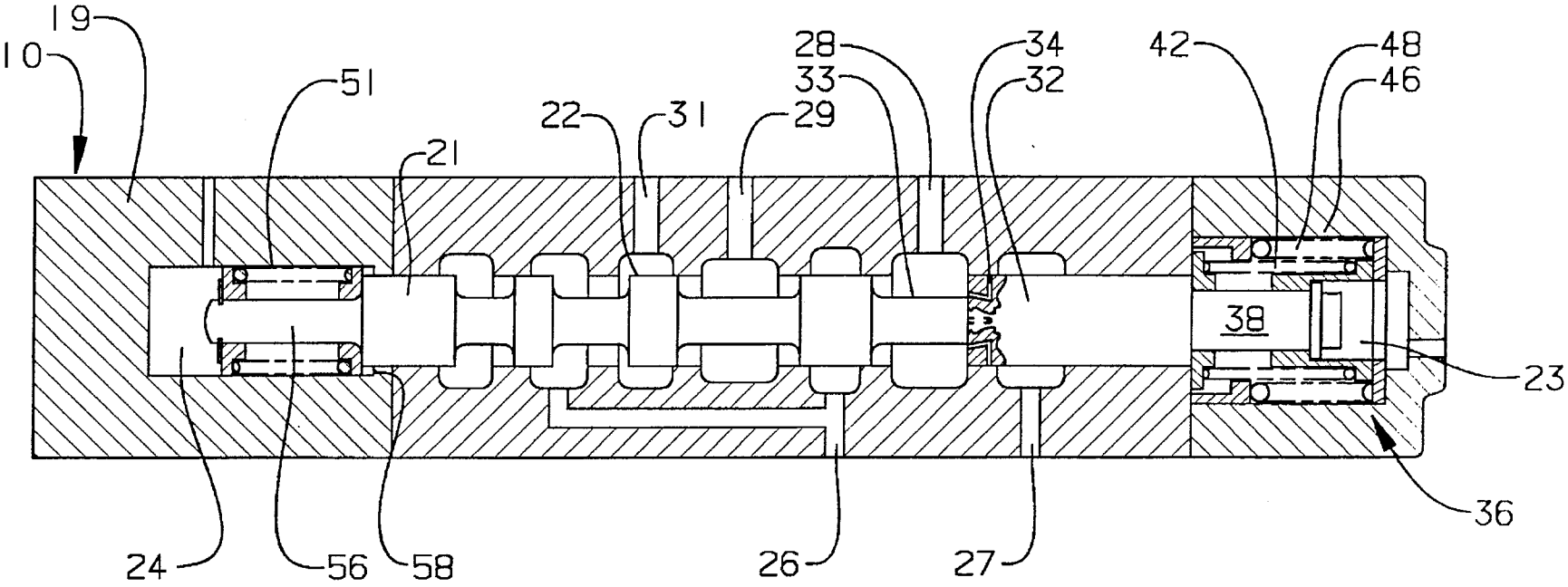
FIG. 4 is a cross sectional view through a control valve shown schematically on FIG. 3.

An alternate embodiment of the hydraulic cylinder snubbing arrangement 9 is shown in FIGS. 3 and 4. It is noted that the same reference numerals of the first embodiment are used to designate similarly constructed counterpart elements of this embodiment. In this embodiment, however, the power piston 62 has been deleted and the valve means 65 includes an electrohydraulic proportional valve 91 connected to the pilot chamber 24 and the means 83 includes a position sensor 92 positioned adjacent the hydraulic cylinder 16 for outputting a command signal through a lead line 93 to the controller 75 when the hydraulic cylinder 16 is retracted to the predetermined retracted position. The pilot pressure established in the pilot chamber 24 is dependent upon the magnitude of the electrical control signal directed to the proportional valve 91.

INDUSTRIAL APPLICABILITY

Figure 2:
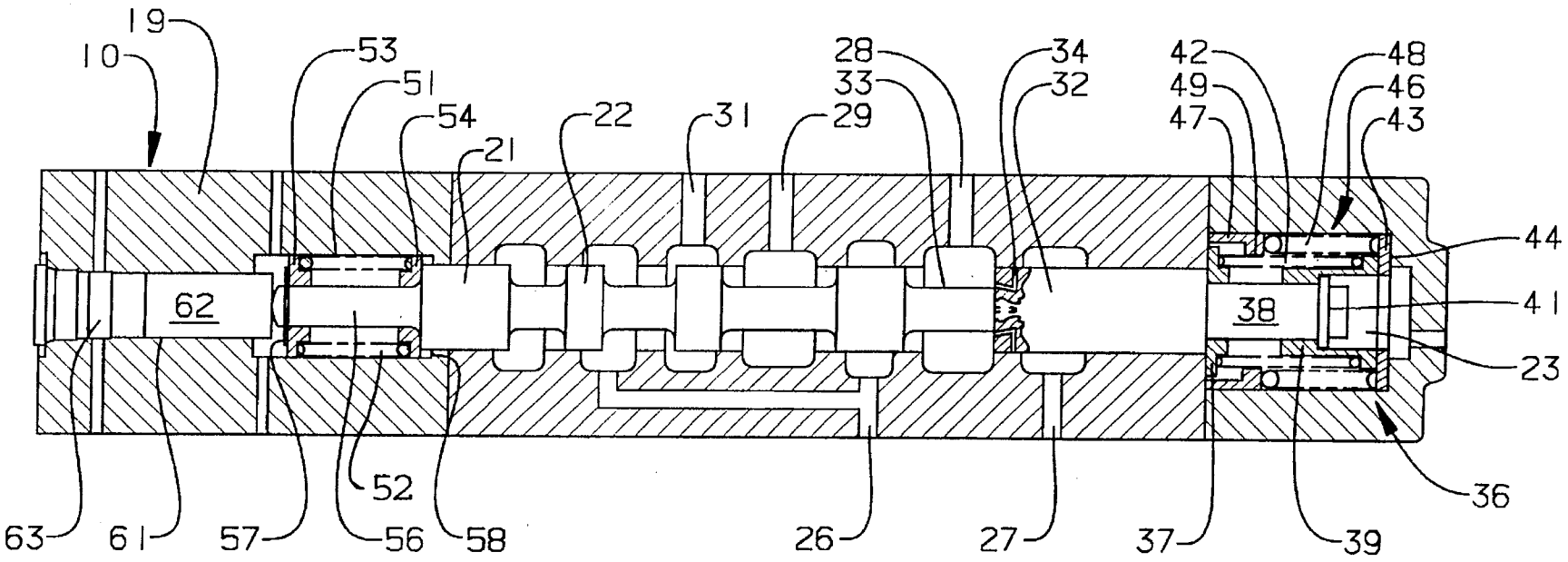
FIG. 2 is a cross sectional view through a control valve shown schematically on FIG. 1.

In the use of the embodiment of FIGS. 1 and 2, the valve spool 22 is movable leftward from a neutral position represented by the letter "N" to a raise position "R", or rightward to one of three actuated positions represented by the letters "L", "F" and "S". At the neutral position shown, the tank port 27 and the cylinder ports 28,29 are blocked from the intake port 26 and from each other and the intake port communicates with the bypass port 31. At the "R" position, the valve spool communicates the intake port with the head end chamber 17, blocks the bypass port 31 from the intake port, blocks the tank port 27, and communicates the rod end chamber 18 with the bypass port 31 so that the hydraulic cylinder 16 is extended to raise the load.

Moving the valve spool 22 to the "R" position is initiated by clockwise movement of the lever 79 to the "R" position to direct a raise command signal to the controller 82 which in turn directs a control signal through the lead line 76 energizing the solenoid valve 69 to its on position for directing pilot fluid into the pilot chamber 23. When the hydraulic cylinder 16 is extended beyond a predetermined distance, the switch 84 automatically closes to energize the solenoid valve 68 to its on position blocking the chambers 63 and 24 from the tank 13.

Retracting the hydraulic cylinder 16 for lowering a load can be accomplished by moving the valve spool 22 to either the "L" or "F" position. At the "L" position, pressurized fluid from the pump 12 is directed to the actuating chamber 18 to establish a powered retraction of the hydraulic cylinder. More specifically, the valve spool blocks the intake port 26 from the bypass port 31, communicates the intake port 26 with the cylinder port 29 and communicates the cylinder port 28 with the tank port 27 through a substantially unrestricted flow path. The "L" position is achieved by counterclockwise movement of the control lever 79 to the "L" position causing the position sensor 81 to direct a lower command signal to the controller 75. The controller processes the command signal and outputs electrical control signals through the lead lines 76,77 energizing the solenoid valves 66,67 to their on positions. At their on positions, the solenoid valve 66 directs pilot fluid into the pilot chamber 63 and the solenoid valve 67 directs pilot fluid into the pilot chamber 24 at pilot system pressure as established by a relief valve. The net force generated by fluid pressure in the chambers 63 and 24 moves the valve spool rightward with sufficient force to overcome the resistance of the centering spring device 36, the bumper spring device 46 and the snubber spring 51.

At the "F" position, the valve spool 22 simultaneously communicates the intake port 26 with the bypass port 31 and the cylinder port 29 and communicates the cylinder port 28 with the tank port 27 through the substantially unrestricted flow path so that the cylinder 16 is essentially retracted by gravity load acting on the cylinder. This position is achieved by moving the control lever 79 to the "F" position to direct a float command signal to the controller. The controller processes the float command signal and outputs a control signal to energize the solenoid valve 66 to the on position for directing pilot fluid into the pilot chamber 63 at pilot system pressure. The force generated by pilot fluid pressure in the pilot chamber 63 is sufficient to overcome the resistance of the spool centering device 36 and the snubber device 51 but is not sufficient to overcome the resistance of the bumper spring 46.

As noted above, the solenoid valve 68 is automatically energized to block the chambers 63 and 24 from the tank once the cylinder is extended beyond a predetermined distance. Thus, the solenoid valve 68 is in the on position when the hydraulic cylinder 16 is being retracted from its fully extended position. However, when the cylinder reaches the predetermined position during retraction, the switch 84 opens to block the electrical signal to the solenoid valve 68 so that it is de-energized to the off position creating a flow path from the pilot chamber 63 and 24. The fluid exhausted from the pilot chamber 24 is substantially unrestricted. However, the fluid exhausted from the chamber 63 passes through both orifices **66*a* and 71 which are sized to reduce the pressure in the chamber 63 to a lower predetermined level. The force thus generated in the pilot chamber 63 is reduced to a value sufficient to allow the snubber spring 51 to move the valve spool leftward from either the "L" position or the "F" position to the snubbing "S" position. At the "S" position, the valve spool 22 communicates the intake port 26 with both the bypass port 31 and the cylinder port 29 and establishes the restricted flow path 35 through the passages 34 between the cylinder port 28 and the tank port 27. Restricting the fluid flow being exhausted from the head end chamber 17** reduces the velocity of the hydraulic cylinder prior to the hydraulic cylinder reaching its fully retracted position. In machines in which the hydraulic cylinder is used for raising and lowering a truck body relative to a frame, the predetermined position is selected so that the velocity of the body is reduced prior to it contacting the frame.

In the embodiments of FIGS. 3 and 4, the fluid pressure established in the pilot chamber 24 is dependent upon the magnitude of the control signal outputted from the controller 82. The controller 82 is programmed so that the control signal to the proportional valve 91 is outputted at three distinct levels dependent upon the command signals from the position sensors 81 and 92.

The "L" position of the valve spool 22 is achieved by counterclockwise movement of the control lever 79 to the "L" position causing the position sensor 81 to direct a lower command signal to the controller 82. The controller processes the command signal and outputs an electrical control signal to the proportional valve 91 at a magnitude selected so that the pressure level of the fluid in the pilot chamber 24 is sufficient to move the valve spool rightward to overcome the resistance of the centering spring device 36, the bumper spring device 46 and the snubber spring 51. Similarly, moving the valve spool 22 to the "F" position is achieved by moving the control lever 79 to the "F" position to direct a float command signal to the controller. The controller processes the command signal and outputs another control signal to the proportional valve 91 at a magnitude selected to generate an intermediate pressure level in the pilot chamber 24 sufficient to overcome the resistance of the spool centering device 36 and the snubber spring 51 but not sufficient to overcome the resistance of the bumper spring 46.

When the hydraulic cylinder is being retracted in either the "L" or "F" position, the sensor 92 detects when the hydraulic cylinder reaches the predetermined position and outputs a command signal to the controller 82. The controller processes the command signal from the sensor 92 and modifies the control signal to the proportional valve 91 by reducing the magnitude of the control signal to a level selected so that the pilot pressure directed to the pilot chamber 24 is reduced to predetermined level sufficient to allow the snubber spring 51 to move the valve spool leftward from either the "L" or "F" position to the snubbing "S" position.

In view of the above, it is readily apparent that the structure of the present invention provides an improved electrohydraulic control valve 10 having a cylinder snubbing function incorporated therein instead of within the cylinder 16. This is accomplished by providing the control valve with a snubbing position for restricting the flow of fluid exhausted from the load supporting end 17 of the cylinder. The control valve is moved to the snubbing position by detecting when the cylinder reaches a predetermined position during retraction and directing a control signal to the solenoid valve 68 or 91 of the valve means 65 for reducing the pilot pressure in the pilot chamber 63 or 24 at the end of the valve spool 22 to allow the snubber spring 51 to move the valve spool to the snubbing position.

Other aspects, objects and advantages of this invention can be obtained from a study of the drawings, the disclosure and the appended claims.

We claim:

1. A hydraulic cylinder snubbing arrangement disposed to reduce the velocity of a hydraulic cylinder as the hydraulic cylinder nears its end of stroke position wherein the hydraulic cylinder has at least one actuating chamber, comprising:

a pilot operated control valve disposed to control fluid flow into and out of the actuating chamber and including a valve spool movable to a first discrete operating position establishing substantially unrestricted fluid flow out of the actuating chamber and to a second discrete operating position establishing a restricted flow path out of the actuating chamber, a pilot chamber at one end of the valve spool, a snubber spring device disposed to resiliently bias the spool from the first operating position to the second operating position when the fluid pressure in the pilot chamber is reduced from a first pressure level to a second lower pressure level;

valve means for establishing the first pressure level in the pilot chamber in response to receiving a first control signal and for establishing the second lower pressure level in the pilot chamber in response to receiving a second control signal;

means for directing the first control signal to the valve means in response to receiving a command signal; and means for directing the second control signal to the valve means when the hydraulic cylinder nears its end of stroke position.

2. The hydraulic cylinder snubbing arrangement of claim 1 wherein the first control signal directing means includes a manually controllable lever movable to a discrete operating position, a position sensor for sensing the operating position of the lever and outputting the command signal, and a controller for processing the command signal and outputting the first control signal.

3. The hydraulic cylinder snubbing arrangement of claim 2 wherein the valve means includes an electrohydraulic valve connected to the pilot chamber and to the controller.

4. The hydraulic cylinder snubbing arrangement of claim 3 wherein the electrohydraulic valve is a proportional valve.

5. The hydraulic cylinder snubbing arrangement of claim 4 wherein the second control signal directing means includes means for detecting when the hydraulic cylinder is near the end of stroke position and outputting a second command signal to the controller, the controller being operative to process the second command signal and modify the first control signal to provide the second control signal.

6. The hydraulic cylinder snubbing arrangement of claim 5 wherein the detecting means includes a position sensor disposed adjacent the hydraulic cylinder to output the second command signal.

7. The hydraulic cylinder snubbing arrangement of claim 5 wherein the valve spool is movable to another discrete operating position intermediate the first and second operating positions and the valve means is operative to establish a third pressure level in the pilot chamber in response to receiving another control signal from the controller, the third pressure level being intermediate the first and second pressure levels.

8. The hydraulic cylinder snubbing arrangement of claim 7 wherein the control lever is movable to another discrete operating position, the position sensor being operative to output another command signal to the control means, the controller being operative to process the other command signal and output the other control signal to the proportional valve.

9. The hydraulic cylinder snubbing arrangement of claim 8 wherein the controller is operative to process the other command signal and modify the other control signal to provide the second control signal.

10. The hydraulic cylinder snubbing arrangement of claim 9 wherein the valve spool includes a plurality of passages therein establishing said restricted flow path at the second operating position of the valve spool.

11. The hydraulic cylinder snubbing arrangement of claim 3 wherein the valve means includes a first solenoid valve connected to the pilot chamber and being movable between an off position blocking fluid flow therethrough into the pilot chamber and an on position for establishing fluid flow therethrough, a second solenoid valve connected to the pilot chamber and movable between an on position blocking communication therethrough from the pilot chamber and an off position establishing fluid flow therethrough from the pilot chamber, and means for reducing the pressure level of the fluid in the pilot chamber to the second lower pressure level when the first solenoid valve is in its on position and the second solenoid valve is in its off position.

12. The hydraulic cylinder snubbing arrangement of claim 11 wherein the reducing means includes a pair of orifices disposed on opposite sides of the pilot chamber.

13. The hydraulic cylinder snubbing arrangement of claim 12 wherein the second control signal directing means includes a normally open switch connected to the second solenoid valve and being positioned relative to the hydraulic cylinder so that the switch closes when the cylinder is extended beyond a predetermined position and opens when the cylinder is retracted to the predetermined position.

14. The hydraulic cylinder snubbing arrangement of claim 13 including a power piston disposed to engage said end of the valve spool, the pilot chamber being disposed at the non-engaging end of the power piston.

15. The hydraulic cylinder snubbing arrangement claim 14 including another pilot chamber defined between said end of the valve spool and the power piston, and a third solenoid valve connected to the other pilot chamber and movable between an off position blocking fluid flow therethrough into the other pilot chamber and an on position for establishing fluid flow therethrough into the other pilot chamber, one of the orifices being positioned between the first mentioned pilot chamber and the second solenoid valve.

16. The hydraulic cylinder snubbing arrangement of claim 15 including a check valve disposed to block fluid flow from the first mentioned pilot chamber to the other pilot chamber.

17. The hydraulic cylinder snubbing arrangement of claim 16 wherein the valve spool includes a plurality of passages therein establishing said restricted flow path at the second operating position of the valve spool.

* * * * *